United States Patent [19]

Jang

[11] Patent Number: 5,031,906

[45] Date of Patent: Jul. 16, 1991

[54] VERSITILE EXERCISING MACHINE

[76] Inventor: Sreter Jang, No. 451, Ta Tien Road, Homei Chen, Changhua, Taiwan

[21] Appl. No.: 624,597

[22] Filed: Dec. 10, 1990

[51] Int. Cl.[5] ..... A63B 21/02

[52] U.S. Cl. ..... 272/137; 272/142; 272/143

[58] Field of Search ..... 272/139, 141, 142, 67, 272/68, 143, 135, 137, DIG. 4

[56] References Cited

U.S. PATENT DOCUMENTS

| | | | |
|---|---|---|---|
| 1,421,198 | 6/1922 | Fidora | 272/142 |
| 4,304,402 | 12/1981 | Ripp | 272/142 |
| 4,865,317 | 9/1989 | Hickey | 272/141 |

*Primary Examiner*—Stephen R. Crow

*Attorney, Agent, or Firm*—Bacon & Thomas

[57] ABSTRACT

A versatile exercising machine, comprising two symmetric handles each having mounting holes at one side for mounting a compression link or three elastic cords, and two pairs of T-shaped blocks respectively releasably connected to the two symmetric handles at two opposite ends thereof. By combining the two pairs of T-shaped blocks with the two symmetric handles, two stands are formed for push-up exercise. By attaching the compression link to the two handles, an exercising unit is provided for exercising the muscles of the muscles of the upper and lower extremities and the abdomen. By attaching the elastic cords to the two handles, a chest expander is formed for developing the muscles of the chest.

1 Claim, 5 Drawing Sheets

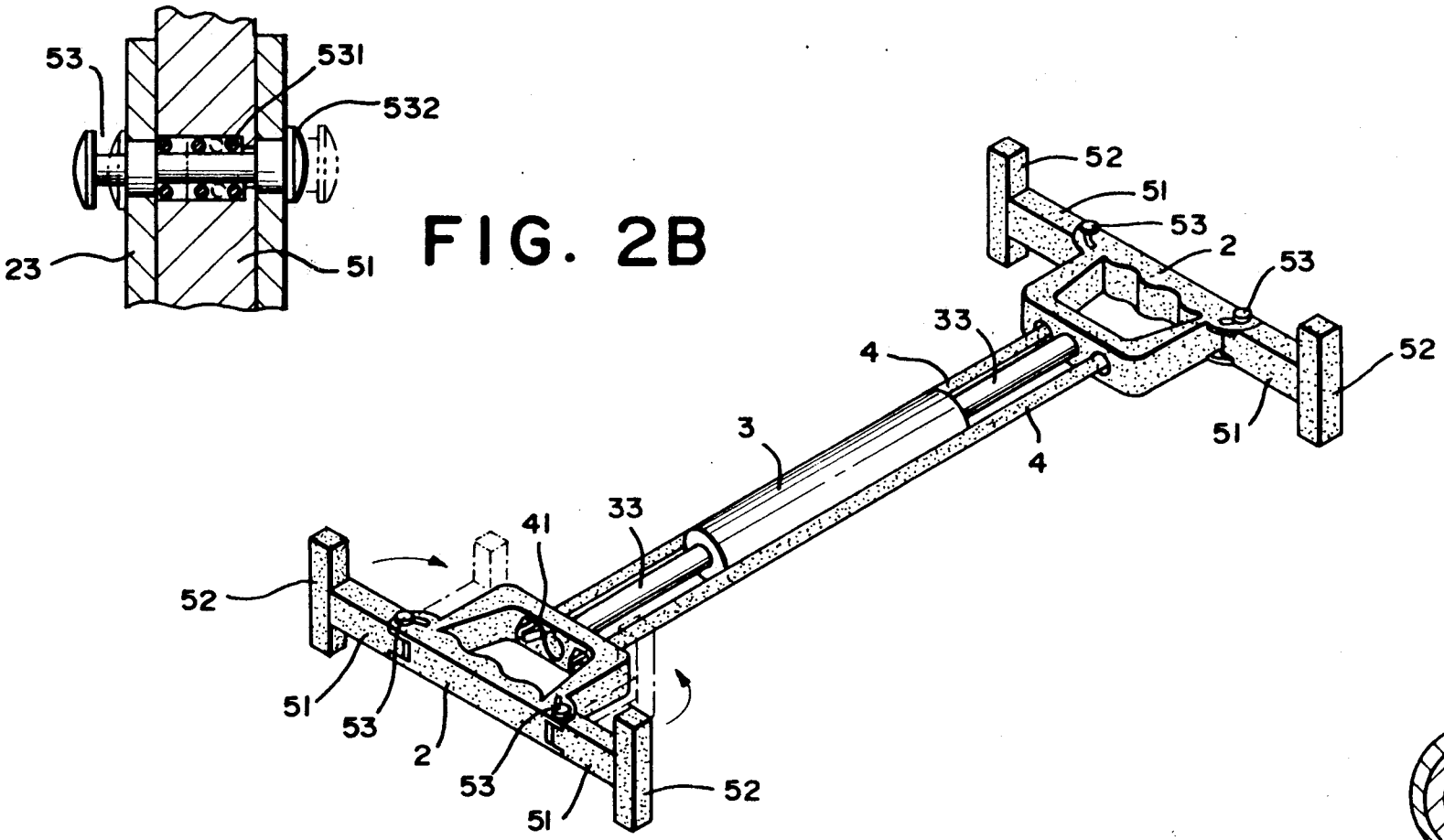
FIG. 2B
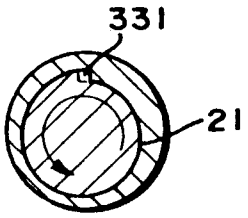
FIG. 2A
FIG. 2

VERSITILE EXERCISING MACHINE

BACKGROUND OF THE INVENTION

1. Field of the Invention

The present invention relates to exercising machines, and more particularly to a versatile exercising machine which is comprised of a pair of handles, a compression link, three elastic cords, and two pair of T-shaped blocks, and which can be flexibly set up into a variety of forms for exercising the muscles of the chest, the back, the abdomen, the upper extremity and the lower extremity respectively.

2. Description of the Prior Art

In gymnastics, a variety of exercising machines nay be respectively used for exercising the muscles of the body. Regular exercising machines are heavy and expensive, and generally designed for a specific purpose, i.e., an exercising machine is specifically designed for training the muscles of a specific part of the body. When to exercise the muscles at different part of the body, different exercising machine may be required. It will be very expensive to prepare a variety of exercising machines for training the body at home. If going to a gymnasium to exercise the body frequently, it is not only expensive but also inconvenient.

SUMMARY OF THE INVENTION

The present invention has been accomplished under the circumstances in view. It is therefore the main object of the present invention to provide an exercising machine which is inexpensive to manufacture and can be used for various purposes.

It is still another object of the present invention to provide an exercising machine which can be flexibly set up into a variety of forms for exercising the muscles of the chest, the back, the abdomen, the upper extremity as well as the lower extremity.

To achieve the above objects, there is provided an exercising machine comprised of a pair of handles which have each through through-holes at the innner side, a compression link which comprises a sleeve having two bolts fastened therein at two opposite end with a compression spring squeezed in therebetween, three elastic cords which have each two fasteners at two opposite ends, and two pair of T-shaped blocks, wherein the aforesaid parts can be flexibly combined together forming into a variety of exercising units for use as a pulling machine, a chest expander, a compressing device, an abdomen exercising machine, a device for push-up exercise or a device for exercising the lower extremity.

BRIEF DESCRIPTION OF THE DRAWINGS

The foregoing and other objects, features and advantages of the present invention will be best understood from the following description, the appended claims and the accompanying drawings in which:

FIG. 2 is a perpective assembly view of the present invention;

Figure 3:
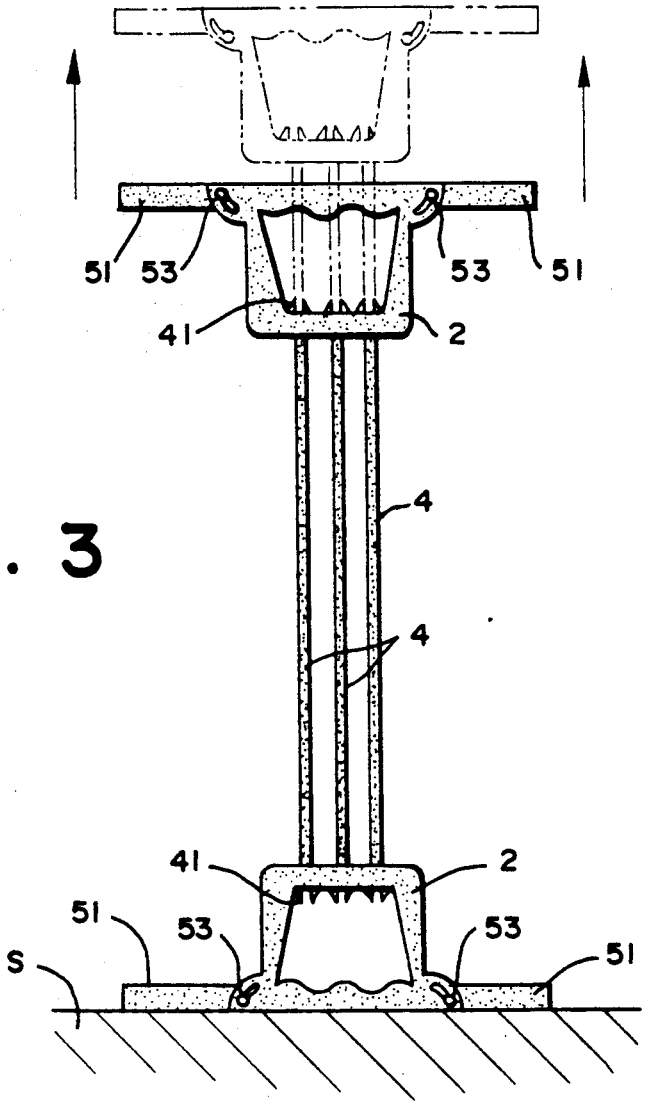
Figure 4:
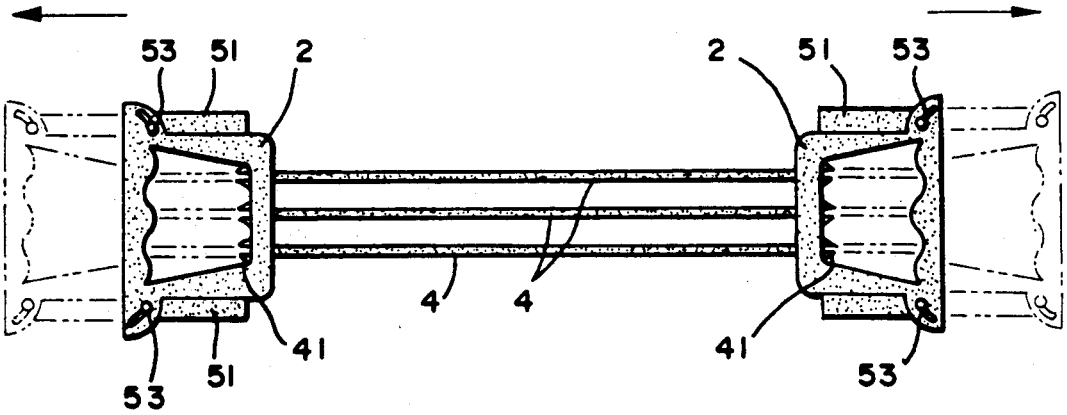
Figure 5:
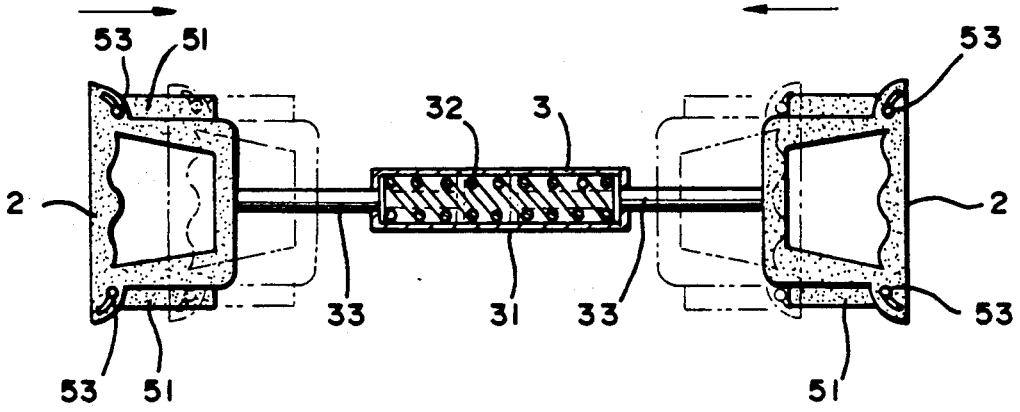
Figure 6:
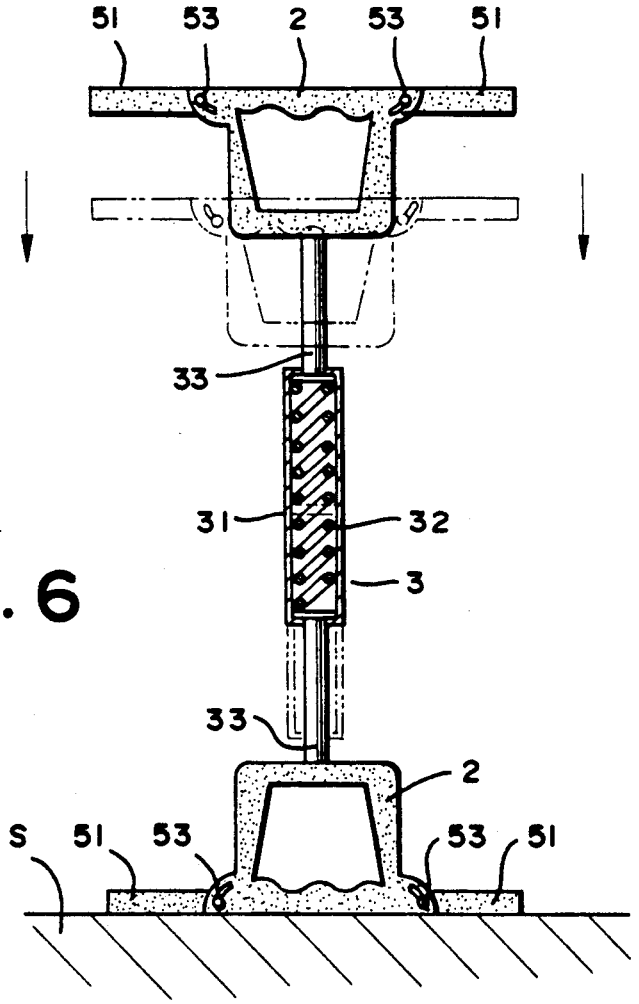
Figure 8:
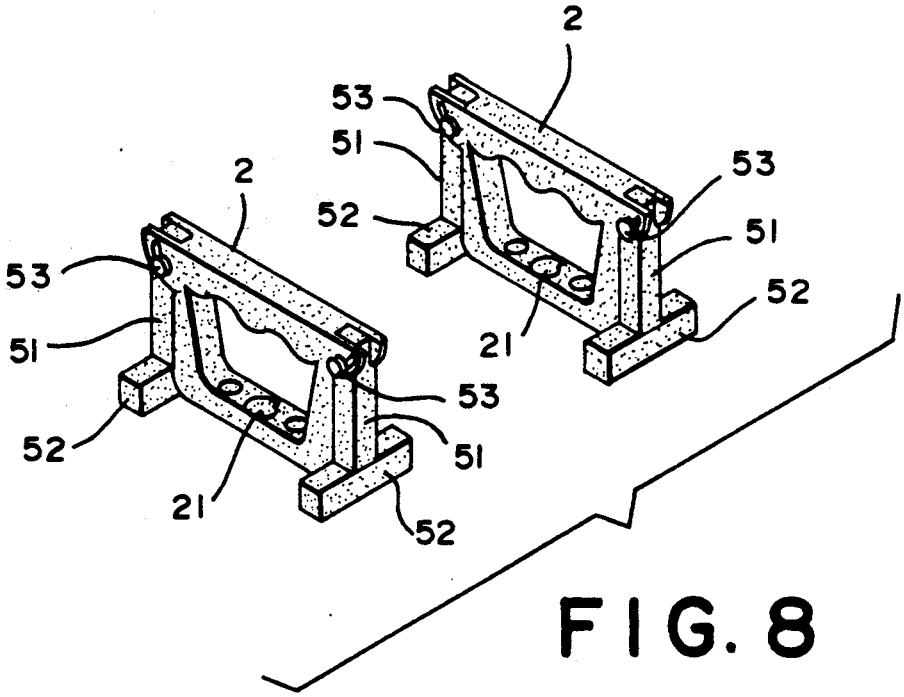
Figure 7:
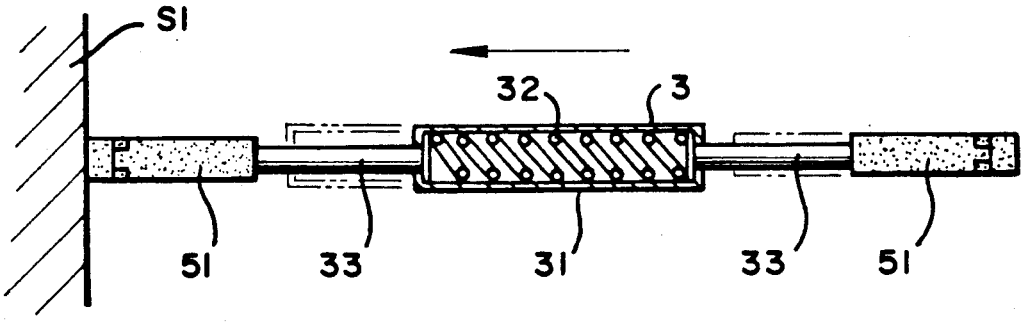

2A is a cross sectional view, illustrating the engagement of the notched end of the bolt in the notched through-hole;

FIG. 2B is a sectional schematic drawing, illustrating the connection of one hand-hold in the recess of the flange at one end of the handle;

FIG. 3 illustrates an alternation of the present invention for use in hand pulling exercise;

FIG. 4 illustrates another alternation of the present invention for use in expanding chest muscles;

FIG. 5 illustrates still another alternation of the present invention for use in hand twisting and compressing exercise;

FIG. 6 illustrates still another alternation of the present invention for use in exercising the legs;

FIG. 7 illustrates still another alternation of the present invention for use in exercising the abdomen; and FIG. 8 illustrates a yet further alternation of the present invention for use in push-up exercise.

DETAILED DESCRIPTION OF THE PREFERRED EMBODIMENT

Figure 1A:
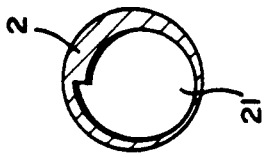
FIG. 1A is a cross sectional view of the notched through-hole.
Figure 1B:
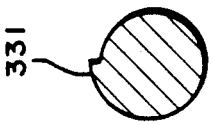
FIG. 1B is a cross sectional view of the notched end of the bolt for the compression link.
Figure 1:
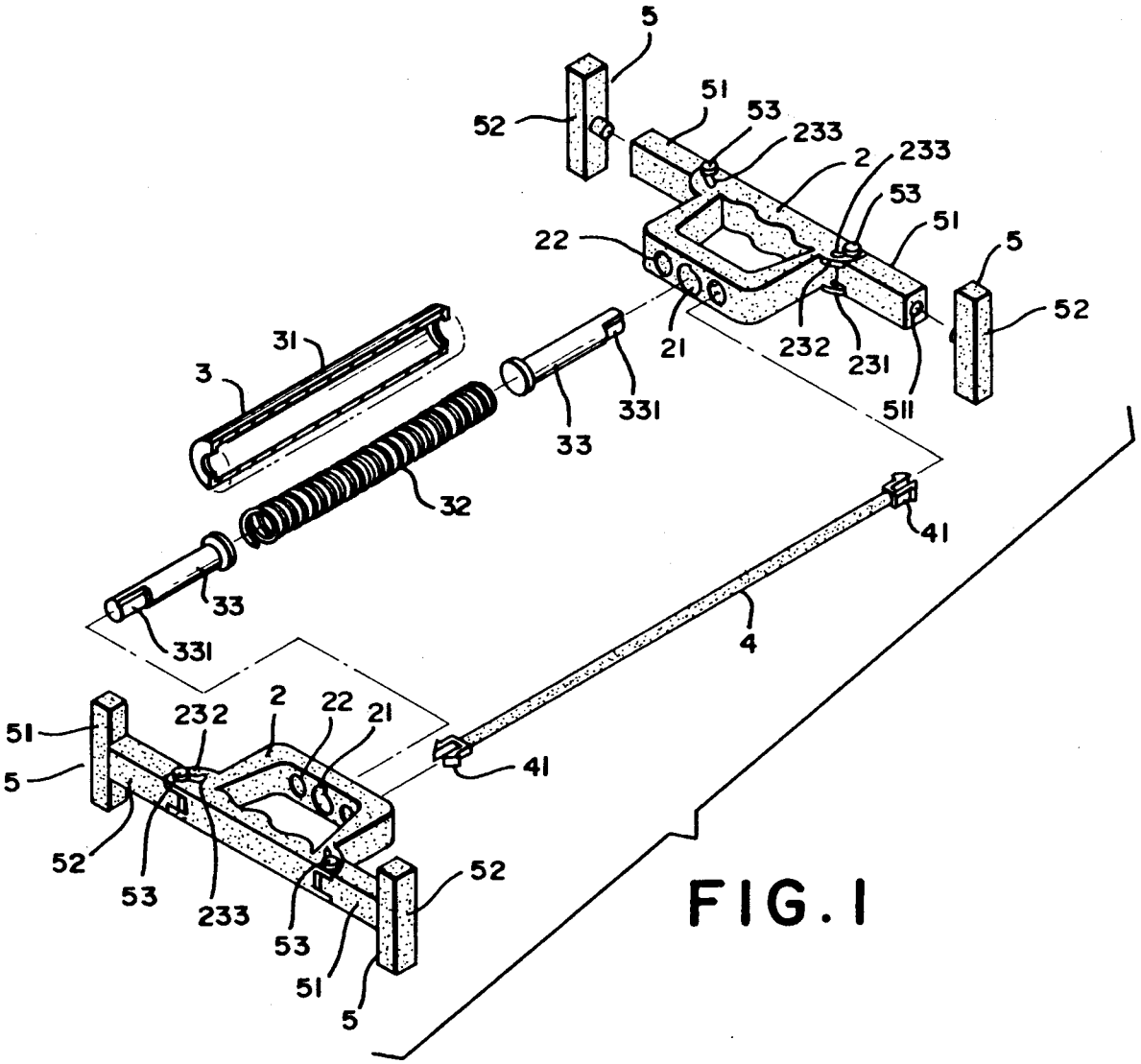
FIG. 1 is a perspective dismantled view of the present invention.

Referring to FIGS. 1, 1A, 1B, 2, 2A and 2B, an exercising machine in accordance with the present invention is generally comprised of two handles 2, a compressio link 3, elastic cords 4, and four T-shaped blocks 5. The two handles 2 are symmetrical, having each two through-holes 22 at one side with a notched through-hole 21 (in shape as shown in FIG. 1A) defined therebetween, and two opposite, circular flanges 23 at an opposite side. The two opposite, circular flanges 23 on each handle 2 have each a recess 231 disposed at the middle, and a curved guide slot 232 vertically piercing through said recess 231, wherein said curved guide slot 232 is terminating in a locking hole 233 at one end. The compression link 3 is comprised of a compression spring 32 received inside a sleeve 3 and respectively stopped by two bolts 33 at two opposite ends. The bolts 33 are respectively fastened inside the sleeve 3 at two opposite end, having each a head stopped against the compression spring 32 and a notched end 331 (in shape as shown in FIG. 1B) protruding beyond the sleeve 31 for fastening in the notched through-hole 21 on each handle 2. After the two bolts 33 of the compression link 3 are respectively fastened in the two handles 2, the notches end 331 of each bolt 33 is firmly engaged with the notched through-hole 21 of each handle 2 (see FIG. 2A). The three elastic cords 4 have each two fasteners 41 respectively secured thereto at two opposite ends for fastening in the through-holes 21 or 22 of the handle 2. The four T-shaped blocks 5 are each comprised of a hand-hold 51 and a side block 52, wherein the hand-hold 51 has stub mortise 511 at one end for mounting the side block 52 through tenon-and-mortise joint, and the opposite end of the hand-hold 51 is fastened in the recess 231 of either of the two flanges 23 of either of the two handles 2 by fastening device 53 which is comprised of a stepped fastening bolt 532 and a spring coil 531 (see FIG. 2B). By controlling the fastening device 53 in the guide slot 232 and the locking hole 233, the hand-hold 51 of each T-shsped block 5 can be firmly retained at a position vertical to the connected handle 2 or collapsed to closely attach thereto.

Referring to FIGS. 3 through 8, the aforesaid parts can be flexibly adjusted into a variety of exercising units for exercising the muscles of different parts of the body. As shown in FIG. 3, the side blocks 52 of the T-shaped blocks 5 are respectively removed from the hand-holds 51 thereof, permitting the hand-holds 51 to be respectively attached to the two handles 2 at the two opposite ends thereof, and the fasteners 41 of the three elastic cords 4 are respectively fastened in the through-holes 21 and 22 of the two handles 2. Thus, an exercising unit is formed for pulling the hand. When in use, the exerciser is held in a vertical position with the two hand-holds 51 of one handle 2 placed on the ground S and stepped by user's legs, and with the two hand-holds 51 of the other handle 2 held by user's hands at the top. Therefore, an user can use this exercising unit for pulling the hand. When the first short rods 51 are respectively collapsed to closely attach to the two handles 2, the exercising unit is formed into a chest expander for developing the muscles of the chest (as shown in FIG. 4). The elastic cords 4 may be removed from the handles 2, permitting the compression link 3 to be secured between the two handles 2 by fastening the notches end 331 of each bolt 33 in the notched through-hole 21 either handle 2, so as to form into another type of exercising unit for hand twisting and compressing exercise (as shown in FIG. 5). When the hand-holds 51 are respectively extended out again, the exercising unit can be held in a vertical position with the two hand-holds 51 of one handle 2 placed on the ground S and firmly held by the user's hands, and with the two hand-holds 51 of the other handle 2 supported by the sole of the user's feet, so that the user who is at a shoulder stand position can use this exercising unit to pull the legs (see FIG. 6). This exercising unit can also be used for exercising the muscles of the hands and the abdomen by stopping one handle 2 at the abdomen S1 and pulling the two hand-holds 51 of the other handle 2 toward the abdomen (see FIG. 7). When the two handles 2 are relatively twisted in a reverse direction, the bolts 33 are respectively disengaged from the two notched through-holes 21, and the compression link 3 can be conveniently removed from the handles 2. After the side blocks 52 respectively attached to the hand-holds 51 which are still connected to the handles 2 respectively, two stands are formed, as shown in FIG. 8, for use in push-up exercise.

I claim:

1. A versatile exercising machine, comprising:

a pair of symmetric handles, each having two mounting holes and a notched through-hole at one side, said notched through-hole being disposed between said two holes, and two opposite connecting ends at an opposite side, said connecting ends each having a recces transversely disposed at the middle, and a curved guide slot vertically piercing through said recess, said curved guide slot terminating in a locking hole at one end;

a compression link comprissing a sleeve having two bolts fastened therein at two opposite end, and a compression spring received inside said sleeve and stopped between said two bolts, said two bolts each having a notches end extending out of said sleeve for fastening in said notched through-hole;

three elastic cords each having two fasteners respectively secured thereto at two opposite ends for releasably fastening in said mounting holes and said notched through-hole;

four T-shaped blocks, being each comprised of a hand-hold and a side block, said hand-hold having a stub mortise at one end for fastening said side block through tenon-and-mortise joint, and an opposite end releasably secured in said recess of said connecting ends by a spring coil and a stepped bolt, permitting said hand-hold to be firmly retained at an expanded position relative to said handles or at a collapsed position to closely attach to said handles, by means of the control of said stepped bolt in said locking hole and said guide slot; and wherein said handles, compression link, elastic cords and T-shaped blocks can be partly or respectively connected together to form into a variety of structures for exercising the muscles of the chest, the back, the abdomen, the upper extremity and the lower extremity respectively.

* * * * *